United States Patent [19]

Bidema

[11] Patent Number: 5,002,274

[45] Date of Patent: Mar. 26, 1991

[54] BASEBALL BATTING PRACTICE DEVICE

[76] Inventor: Mark D. Bidema, 2101 Putnam Ave., Antioch, Calif. 94509

[21] Appl. No.: 525,167

[22] Filed: May 16, 1990

[51] Int. Cl.[5] ..... A63B 63/00

[52] U.S. Cl. ..... 273/26 A; 273/410

[58] Field of Search ..... 273/26 A, 29 A, 181 F, 273/181 K, 182 R, 410, 181 J

[56] References Cited

U.S. PATENT DOCUMENTS

| | | | |
|---|---|---|---|
| 2,839,300 | 1/1956 | Blaha | 273/26 |
| 2,895,737 | 7/1959 | Blus | 273/26 |
| 2,944,816 | 7/1960 | Dixon | 273/26 A |
| 3,001,795 | 9/1961 | Johnson, Jr. | 273/26 A |
| 3,197,208 | 7/1965 | Makar | 273/26 A |
| 3,339,925 | 9/1967 | Nissen | 273/410 |
| 3,874,662 | 11/1973 | Harrington | 273/26 E |
| 4,116,446 | 9/1978 | Thompson | 273/181 F |
| 4,322,075 | 9/1980 | Hynes | 273/26 E |
| 4,381,110 | 9/1981 | Balaz | 273/182 R |
| 4,383,686 | 5/1983 | Cardieri | 273/26 R |
| 4,402,507 | 9/1983 | Hudson | 273/26 R |
| 4,703,931 | 11/1985 | Stun | 273/26 A |
| 4,815,736 | 7/1986 | Wright | 273/26 A |
| 4,826,166 | 12/1986 | Baker | 273/55 R |
| 4,830,371 | 6/1986 | Lay | 273/26 E |
| 4,842,284 | 6/1989 | Rushing et al. | 273/26 A |
| 4,863,166 | 9/1989 | Becera et al. | 273/26 A |
| 4,883,272 | 11/1989 | Lay | 273/26 A |
| 4,932,657 | 1/1990 | Hailer et al. | 273/26 A |
| 4,955,607 | 9/1990 | May | 273/26 A |

OTHER PUBLICATIONS

Popular Mechanics, pp. 128–129, 8/62.

*Primary Examiner*—Theatrice Brown

[57] ABSTRACT

A portable baseball batting practice device is disclosed as including a rectangular upright frame, defined by two separate upper and lower vertical frame sections retained and interposed by coupler units; frame is vertically supported by support members connected to each side of the upper vertical frame section and extending back vertically joined at support unit, retaining support members in position; a pair of extension legs join a baseball batting tee to the lower vertical frame section permitting horizontal to vertical rotation thereof; the baseball batting tee comprising of a pair of interchangable, flexible ball receiving elements and an upper tee stem inserted into a lower tee stem permitting height adjustability and retained vertically by tee base; a vertical flexible net is suspended from the upper vertical frame section covering the opening between the upper and lower vertical frame sections presenting an impact area for a driven ball.

6 Claims, 3 Drawing Sheets

BASEBALL BATTING PRACTICE DEVICE

BACKGROUND OF THE INVENTION

The present invention relates to a baseball batting tee in combination with a utility backstop. Its function is as a self contained, portable baseball batting practice device, that can be used in a confined area by a single person, indoors or outdoors.

PRIOR ART

Heretofore, batting practice devices in the past, for developing and improving a player's batting mechanics, have not considered a single self contained device which can be used by both the young novice, as well as the more accomplished professional. Past art references are either specialized for related age groups making them impractical, inconvenient and sometimes frustrating to use or too expensive for the average ballplayer and limited in regard to flexiability.

I came to this conclusion after using a variety of these devices my self, as well as with my own 4 year old son and after examining the prior art references (U.S. Pat. Nos. 4,402,507, 2,839,300 and 4,383,686. Sports Illustrated article. Mar. 5, 1979. I.B.I publication #102 "My First Hitting Book" pgs. 22 and 23).

Batting tees with and without tethered ball, ball tossing and tethered ball devices extended from pole, are in one way or another, limited in their application. Example: with a tethered ball extended from a pole, if the ball is missed, which is bound to happen and the player swings to high, the rope can wrap around the bat with a possibility of the ball hitting them in the head, or injury to their upper body caused by the sudden torque.

Using ball tossing and batting tee devices without a tethered ball, require at least two players, to alliveate having to collect the batted balls later. The ball tossing device also requires a great deal of cordination which most young ballplayers have yet to fully develop. The player must almost simultaneously stepdown to activate ball, then hit the ball suspended in space, when they cannot hit the ball it becomes very frustrating causing discouragement. Attempting to instruct a player using either one of these devices, a third person is required to catch batted balls otherwise, you have to instruct while playing the field which becomes very frustrating to both the batter and the instructor.

When using batting tees with tethered balls, after each swing the ball must be reeled in and placed back on the tee. This does not allow the batter enough continuous repetitions of the swing motion to create a batting rhythm, facilitating the development and perfection of the player's batting mechanics.

Most of these prior art references are not used by the serious baseball player, because they fail to adequately assist the player in developing and perfecting their batting mechanics.

The following prior art references are commonly used by both the young novice and more accomplished ballplayer and adequately assist in devloping batting technique but are either inconvenient or limited with regard to versatility that my device would provide.

The Sports Illustrated article, Mar. 5, 1979 pg. 44 is very similar to the device that inspired me. Nonetheless this device fails to be portable, the ballplayer must go to where it is set up and it lacks the capability of being used indoors. The device that I have purposed will provide the ballplayer with the flexibility of taking the device with them and practicing virtually wherever and whenever they choose indoors, outdoors, at home, in the backyard, garage, ballpark, playground, etc.

Finally, the I.B.I publication #120 "My First Hitting Book" pgs. 22 and 23. The batting tarp fails to be self supporting, the tarp is useless without a garage door or fence to hang it from, the use of this device is limited to what is available around it. The device that I purpose has a self supporting frame which allows it to be used just about anywhere including an open field.

In my search of prior art, in particular batting tees and utility backstops, I could not find any prior art references that combined both of these devices as one convenient, self contained, portable unit.

Additional examples of prior art references U.S. Pat. Nos. 2,895,737, 4,703,931, 3,980,304, 2,331,236, 4,136,869 and parent case 07/392,088.

OBJECTS AND ADVANTAGES

Accordingly, several objects and advantages of my invention permits an individual from the young novice to the accomplished ballplayer, to develop and perfect their batting mechanics in a confined area indoors or outdoors, with or without assistance.

Unlike the previously stated prior art references, I have considered the young novice as well as the more accomplished ballplayer, and their instructor. This device allows the batter and instructor to remain together, facilitating any instructions. The instructor places one ball after another upon the batting tee, while the batter concentrates on hitting each consecutive ball or the batter can by themself place the ball on the tee without assistance.

The balls are batted off the batting tee into a flexible material suspended from the vertical frame. The balls then drop to the ground. Once all the balls are batted, they are then conveniently collected and the exercise may be repeated if desired.

This formation is constructed by two extension legs, extending horizontally along the ground from the bottom horizontal leg of the vertical frame, to the batting tee base creating a self contained batting practice device.

The extension legs and the batting tee rotate to a vertical position, resting against the flexiable netting when the device is not in use.

The batting tee allows for vertical adjustment, relative to the batter's height, and the flexible conventional batting tee head is detachable from the tee stem allowing for replacement with a specially designed flexiable training tee head. The function of the vertical batting head is like that of any conventional tee in that, it is designed to hold a ball enabling a batter to hit it. The function of the training tee head is similar, with several added features. This batting tee head provides less vertical ball lift making it more difficult to cheat, that is making contact with the ball and tee head together when batting, the idea is to hit the ball not the tee. This batting tee head forces the batter to be more consistent and accurate when making ball contact. When either of these batting tee heads are hit too severally too many times the tee stem will eventually disconnect from the tee base, and the batter will have to stop batting, pick up the tee stem, clip it back into the base mount, and then resume batting. The training tee head also disciplines batters not to drop their back shoulder, which causes the bat head to lower, and if dropped far enough, will strike the batting tee, again force the tee stem to release from the tee base mount. The final feature of the traning tee head is that it allows a batter to rotate the tee head and position it for inside, outside or stright on simulated pitching.

Another use adapted for this device is a "toss drill" and "drop drill". The "toss drill" involves an individual kneeling just in front and to the side of the batter, tossing a ball in front of the batter and the batter hitting the ball into the flexible material. The "drop drill" involves an individual standing and holding a ball above the batter's strike zone. The ball is dropped, the word is given to swing, and the batter responds by attempting to hit ball while dropping into flexible material.

Each of these different features of the device develops specific characteristics needed to become a good hitter. The "toss drill" develops space relationship, attempting to hit a ball suspended in space. The "drop drill" develops reaction time and makes for strong and quick wrists.

When storing or transporting this device the upper and lower halves of the vertical frame are coupled together, they are perpendicular to the horizontal bars, allowing top and bottom horizontal bars to meet, reducing vertical height by half. The leg support members and extension bars are disconnected and packed away for transporting.

It is therefore a general object of the present invention to provide a device, for baseball batting practice that combines the baseball batting tee with a utility backstop, which may be used with or without assistance.

It is another object of the present invention to provide a baseball batting device, which may be used in an area limited in space, indoors or outdoors.

It is still another object of the present invention to provide a baseball batting device, that may be used by the young novice and the accomplished professional.

It is a further object of the present invention to provide a baseball batting device, wherein the ball height is adjustable to the batters height.

It is yet another object of the present invention to provide a baseball batting device, which allows the batter practice in hitting simulated pitches of several types.

It is a further object of the present invention to provide a baseball batting device, wherein the batting coach can instruct the batter without having to be concerned with where the batted balls are travelling and can remain with the batter.

It is still a further object of the present invention to provide a baseball batting device, that allows the batter to hit consecutive balls, while maintaining a continuous batting rhythm.

It is still a further object of the present invention to provide a baseball batting device, wherein the batted balls are convenient to retrieve.

It is another object of the present invention to provide a baseball batting device, by which a ball player can take warm-up swings at home or at the ballpark before stepping into a pitching situation.

It is still another object of the present invention to provide a baseball batting device were batters can devlop space relationship, reaction time, and strengthen wrists.

It is an additional object to provide an adequately sized, conveniently portable batting practice device easy to manufacture and construct, economically practicle and durable in construction.

Although one of the principal achievements of the invention is that of devloping and perfecting a batter's batting mechanics, this device in accordance with the invention can also be used as a means to practice pitching, golfing and may be used in connection with other sports for actual play or practice.

Further objects and advantages of my invention will become apparent from a consideration of the drawings and ensuing description of it.

DESCRIPTION AND OPERATION OF INVENTION

Figure 1:
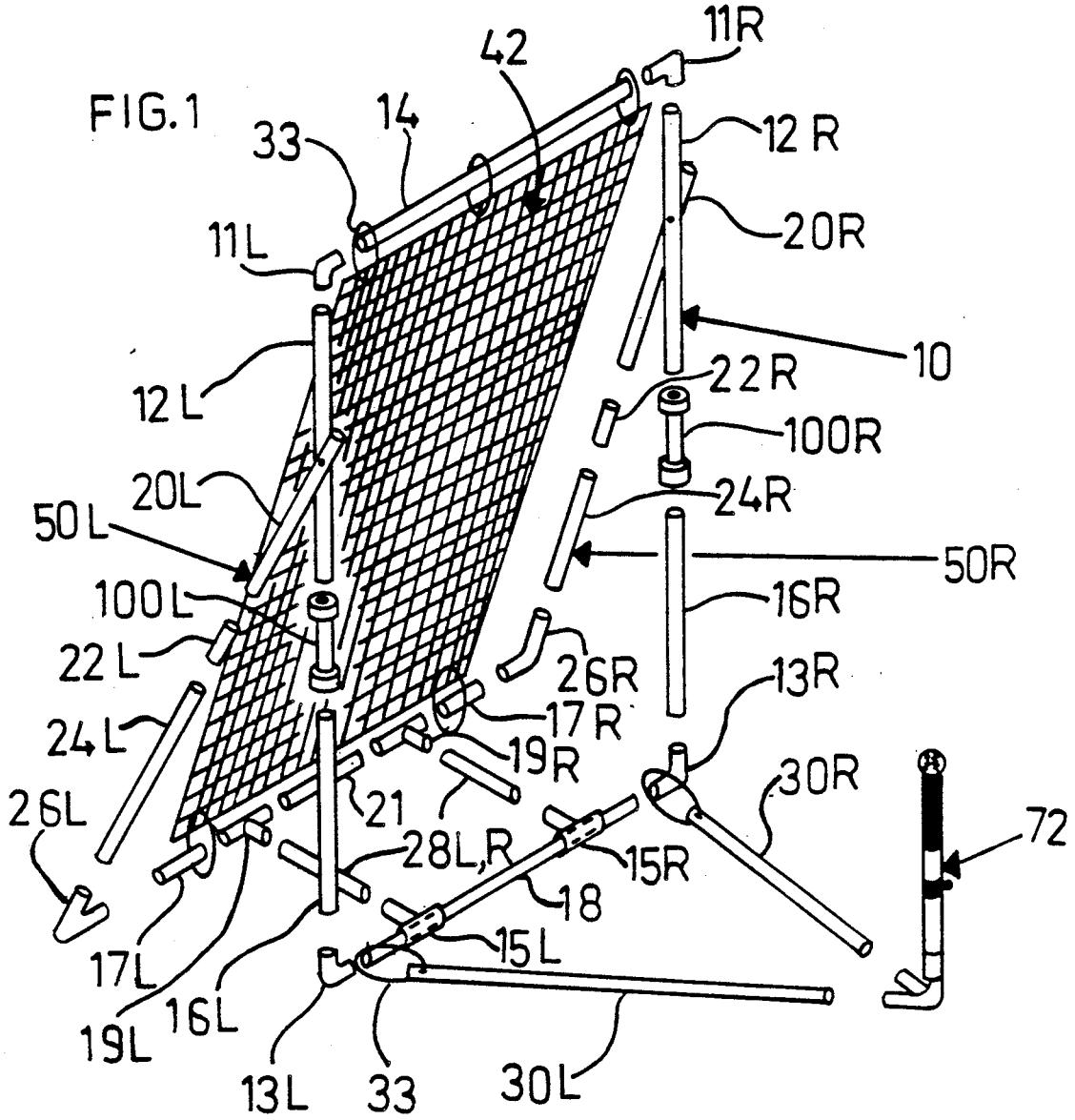
FIG. 1 is an exploded plan view of the present invention.
Figure 2:
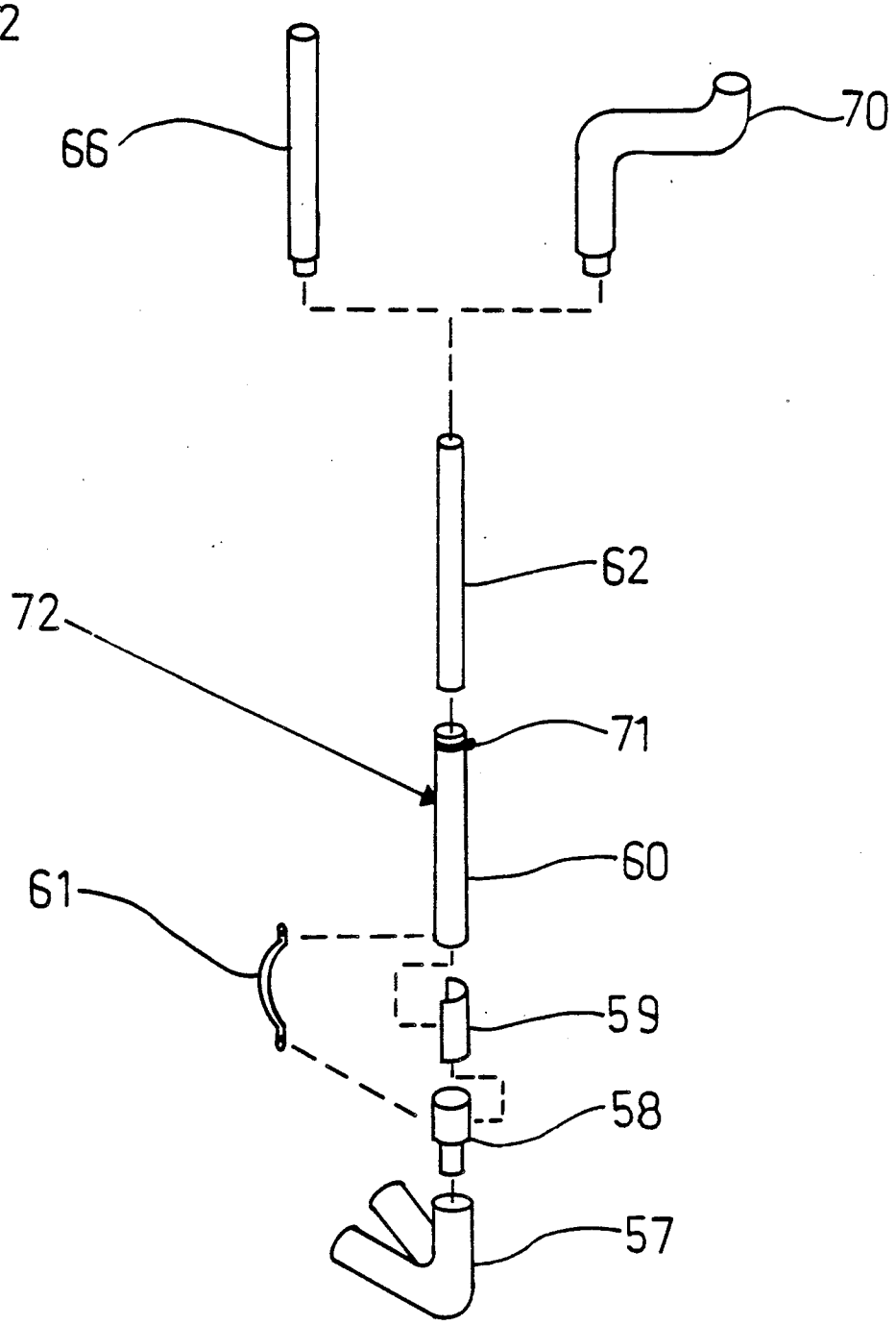
FIG. 2 is an exploded plan view of the batting tee.

The baseball batting practice device of the present invention is shown in FIG. 1.

The frame is shown at 10, rectangular in shape, made of plastic or metallic tubing or pipe divided in two separate upper and lower sections. The upper section 12L,12R,11L,11R,14 and the lower section 16L,16R,13L,13R, 18 both sections are joined together by couplings 100L and 100R. Support members 50L and 50R consists of joining sections 20L,22L,24L and 20R,22R,24R respectively and provides rear support to frame 10. Support members 50L and 50R are fastened to vertical bars 12L and 12R by screws and locknuts. Support unit 26L,17L,19L,28L,15L,21,19R,28R,15R,17R, 26R is connected to support members 50L and 50R. Support unit provides vertical stability to support members 50L,50R and frame 10.

The flexiable material 42 in FIG. 1 preferably netting, is carried in the vertical frame 10. The flexible material is fastened to and suspends from the top horizontal leg 14 covering the area between vertical bars 12L,12R,16L,16R and connected to frame 10 by plastic ties, presenting an impact area for a driven ball. Vertical surface 42 should not be hard and unyeilding. The surface should have enough yieldability so that when the ball makes contact, it dissipates the kenetic energy of the ball, but not so resilent that it allows the ball to bounce back at you.

The one end of extension legs 30L and 30R are attached to horizontal leg 18 by plastic ties allowing for vertical and horizontal movement the other end is inserted into batting tee base 57.

The batting tee 72 (see FIG. 3 drawing) is supported by tee base 57,58,59 respectively, providing vertical stability. Lower tee stem 60 is held to tee base by plastic clip. Upper tee stem 62 is inserted into lower tee stem 60 and held secure by clamp 71 providing height adjustment. Upper tee stem 62 is inserted into flexiable ball recieving elements 66 or 70.

Coupler units 100L and 100R consist of a coupler body 103L,R, upper and lower rubber bushings 102L,R and an upper and lower coupler cap 101L,R joining the upper and lower sections of frame 10.

Male couplers 11L,11R,13L,13R,22L,22R,26L,26R, 19L,19R,15L,15R,57 are threadless.

In construction of FIG. 1 the ball when hit off the batting tee into the flexible material 42, is yieldable to only a limited distance before the slack is taken up and the material becomes taut, causing the ball to drop to the ground providing convenient ball retrival.

Figure 3:
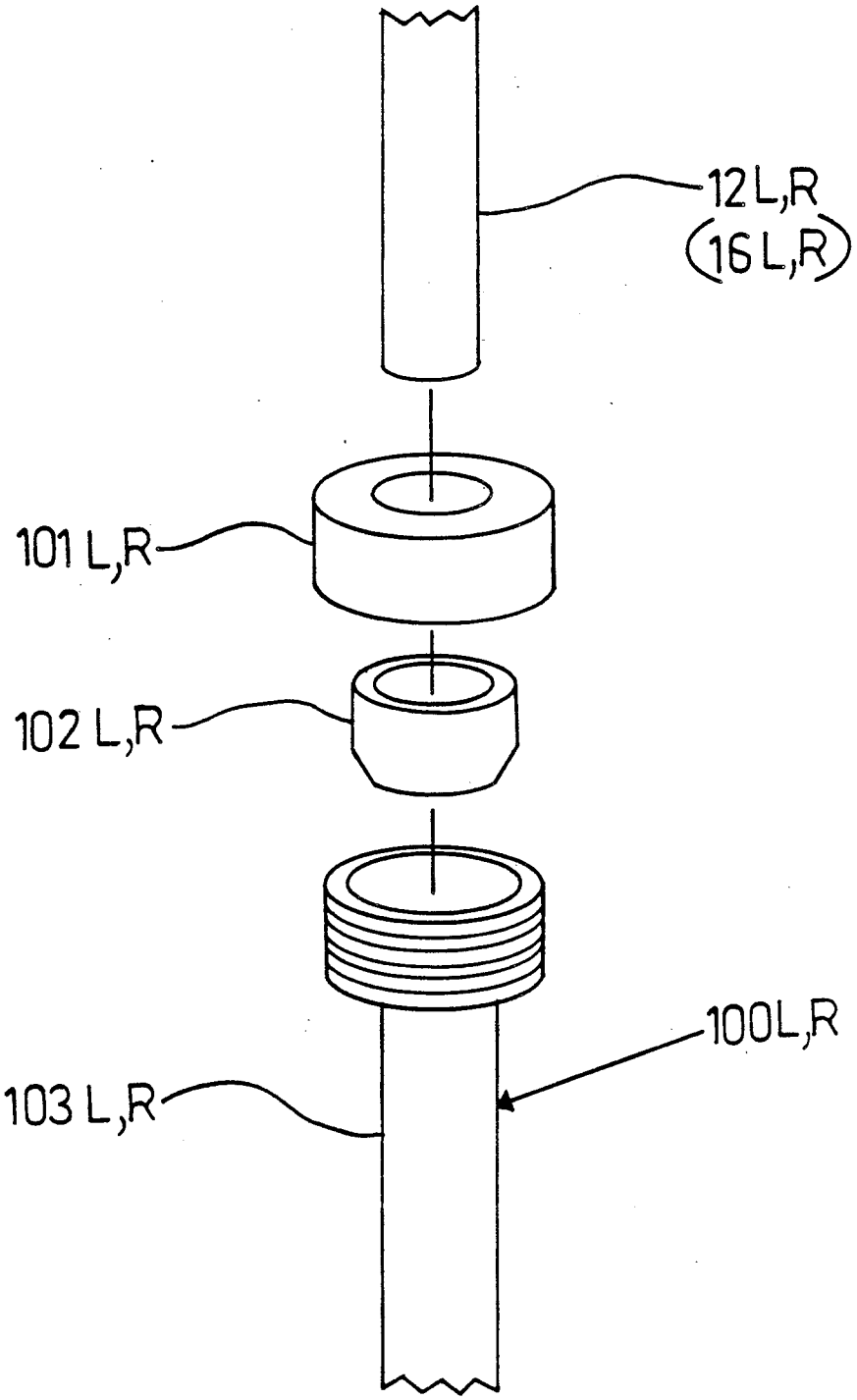
FIG. 3 is an exploded plan view of the compression coupling.

Before use, the batting tee 72 of FIG. 3, may be adjusted for desired ball height, relative to the batter. The batting tee height is achieved by raising or lowering the upper tee stem 62, which slides up or down inside the lower tee stem 60. The clamp 71 retains the upper tee stem 62 in position. The horizontal distance between the batting tee 72, and vertical frame 10, is determined by the length of the extension bars 30L and 30R.

The conventional batting tee head 66 can also be removed and replaced with the innovative training tee head 70, providing the batter with a heightened level of batting discipline. Another feature associated with this tee is the detachable lower stem 60 from the tee base clip 59. On impact the lower tee stem releases from the tee base forcing the batter to stop, and replace the batting tee 72 back onto the tee base 56 by snapping it into the tee base clip 59, retainer strap 61 secures batting tee unit 72 to tee base 57,58,59 respectively. The 3-fold function of this feature is to, (1) prevent possible damage to the batters upper body due to contact stress caused by swinging too low and hitting the batting tee, (2) to prevent possible damage to the batting tee, and (3) to develop batting mechanics or muscle memory.

When not in use the vertical frame 10 can remain upright and the extension legs 30L and 30R along with the batting tee can be raised vertically against the net 42.

When storing device away completely, tee base 57 is detached from extension legs 30L and 30R. Tee base 57,58,59 respectively along with batting tee 72 is stored away. Support member 24L and 24R are disconnected from 26L,26R,20L,20R respectively allowing frame 10 to be lowered. Coupler units 100L and 100R are removed at either the upper or lower end by loosening but not removing the coupler cap 101L,R and sliding corresponding vertical leg out. The upper and lower sections of vertical frame 10 are then placed one on top of the other conveniently carried at horizontal bars 14 and 18.

The support members 50L and 50R are stored away, extension legs 30L and 30R are folded crossing on top of one another together. The device can then be stored against or on a convenient wall.

Thus the reader will see that this invention provides everything that the young novice or the more accomplished baseball player might need. A baseball batting practice device that is economical, durable, portable, self contained and very simple to manufacture. This device as well is great for pitching, golfing, football etc.

While we have shown and described specific embodiments of the present invention, it will of course be evident that various modifications and alternative constructions may be made without departing from the true spirit and scope thereof. We therefore intend by the appended claims to cover all such modifications and alternative constructions as come within their true spirit and scope.

What I claim as new and desire to secure by Letters Patent of the United States is:

1. A batting practice device comprising; a rectangular substantially planar vertically extending frame having upper and lower sections, each said upper and lower section having an elongated horizontal tubular member and a pair of elongated spaced apart vertical tubular members, a coupling member coupling said vertical members of said upper and lower sections in parallel alignment to define said rectangular frame, a pair of elongated tubular support members of equal length attached at one end thereof to and intermediate the ends of said vertical members of said upper section and extending angularly downwards therefrom, the other end of each support member being attached to an elongated tubular base member extending therebetween, said base member and said horizontal member of said lower section being spaced apart and connected by at least one spacer member; a substantially rectangular shaped netting material having one of its edges attached to said horizontal member of said upper section and the opposite edge attached to said base member, said netting material covering the area within said frame for a driven ball, a pair of horizontally extending tubular members of equal length having one end thereof pivotally attached to said horizontal member of said lower section and extending to coverage towers each other and having their other end connected to each other at a common point, a vertically extending ball support tee, said tee having an upper ball support end and a lower base end, said base end being connected to said extension members at said common point; said tee further having a flexible ball receiving element attached to said ball support end, said ball receiving element being tubular and slidably adjustable on the upper end of said ball tee thereby providing tee height adjustment.

2. A batting practice device as defined in claim 1 wherein, said ball receiving element is straight.

3. A batting practice device as defined in claim 1 wherein said ball receiving element has a pair of curved sections.

4. A batting practice device as defined in claim 1 wherein, tubular members have releasable, telescoping connections whereby said device can easily be disassembled for storage.

5. A batting practice device as defined in claim 1 wherein, said netting material is connected to said frame by means of plastic tie elements.

6. A batting practice device as defined in claim 1 wherein, said ball tee has a releasable step portion between said upper ball support end and said base end, said stem portion being connected to said base end by a releasable retaining clip whereby said stem portions will be released from said base end when said tee is struck by a bat.

* * * * *